US005927852A

United States Patent [19]

Serafin

[11] Patent Number: 5,927,852

[45] Date of Patent: Jul. 27, 1999

[54] PROCESS FOR PRODUCTION OF HEAT SENSITIVE DISPERSIONS OR EMULSIONS

[75] Inventor: Mark Serafin, Apple Valley, Minn.

[73] Assignee: Minnesota Mining and Manfacturing Company, St. Paul, Minn.

[21] Appl. No.: 08/980,526

[22] Filed: Dec. 1, 1997

[51] Int. Cl.[6] ..... B01F 15/06

[52] U.S. Cl. ..... 366/144; 366/162.4

[58] Field of Search ..... 366/144, 145, 366/162.4, 152.1, 182.2, 182.1, 173.2, 173.1; 137/14, 334, 3, 4

[56] References Cited

U.S. PATENT DOCUMENTS

| | | | |
|---|---|---|---|
| 2,976,024 | 3/1961 | Martinek | 366/162.4 |
| 3,833,718 | 9/1974 | Reed | 366/162.4 |
| 4,115,066 | 9/1978 | Muhle | 366/162.4 |
| 4,533,254 | 8/1985 | Cook et al. . | |
| 4,966,466 | 10/1990 | Soechtig | 366/152.1 |
| 5,026,427 | 6/1991 | Mitchell et al. . | |
| 5,366,287 | 11/1994 | Verstallen . | |
| 5,423,607 | 6/1995 | Jones et al. | 366/152.2 |
| 5,635,206 | 6/1997 | Ganter et al. . | |

FOREIGN PATENT DOCUMENTS

| | | |
|---|---|---|
| WO 95/35157 | 12/1995 | WIPO . |
| WO 96/14925 | 5/1996 | WIPO . |
| WO 96/14941 | 5/1996 | WIPO . |

OTHER PUBLICATIONS

Itochu, Ultrafine granulation, emulsion, and dispersion device, Ultimaizer® System, Translation of Promotional Brochure.

Microfluidizer Processing User Guide, Microfluidics Corporation Catalog, May 1997.

Tamir and Kitron, "Applications of Impinging–Streams in Chemical Engineering Processes—Review," pp. 241–330.

Microfluidizer Processing, Microfluidics Corporation Catalog, 1993.

Microfluidics Corporation Technical Bulletin M–110Y, 1990.

Microfluidics Corporation Technical Bulletin M–110EH, Jun. 1993.

Microfluidics Corporation Technical Bulletin M–210–EH, 1992.

*Primary Examiner*—Tony G. Soohoo

[57] ABSTRACT

The invention is an apparatus and process for making multi-phase mixtures. The apparatus includes a high pressure pump, at least two high pressure mixing zones in series, and a high pressure heat exchanger located before the last high pressure mixing zone.

17 Claims, 2 Drawing Sheets

PROCESS FOR PRODUCTION OF HEAT SENSITIVE DISPERSIONS OR EMULSIONS

FIELD OF THE INVENTION

This invention relates to a process and an apparatus for the production of heat sensitive dispersions or emulsions. This invention relates especially to production of dispersions used in making magnetic recording elements.

BACKGROUND OF THE INVENTION

Dispersions are solids particles dispersed in a fluid medium. Emulsions are stable mixtures of two immiscible fluids. Preparing dispersions or emulsions by rapidly passing the materials through passages of unique geometries is known. These methods typically involve subjecting the materials to highly turbulent forces. One particularly effective means includes passing streams of the materials to be mixed through orifices so that the materials impinge upon each other. See e.g. WO96/14925, incorporated herein by reference. Such processes are known to generate substantial heating of the process stream. Thus, heat exchangers have been used before and/or after the mixing process.

SUMMARY OF THE INVENTION

The Inventor has created improved dispersion and/or emulsion preparing method and apparatus. The apparatus includes a high pressure pump and a series of at least two high pressure mixing zones.

The inventor found that when two or more of these mixing zones are used in series, having heat exchangers only before and/or after the series does not provide adequate cooling to the system. Thus, according to a first embodiment, there is a high pressure heat exchanger between the at least two mixing zones. Including a heat exchanger at this step of the process was found by the Inventor to provide much better dispersion characteristics than if heat exchangers are used only before and/or after the series of mixing zones.

Additionally, the present invention is a process of making multi-phase mixtures, such as emulsions or dispersions, in which the process comprises the steps of:

a) pressurizing the components of the mixture b) passing the components through a first high pressure mixing zone, c) after passing the components through the first mixing zone, passing the pressurized components through a heat exchanger to cool the components, and d) after passing the pressurized components through the heat exchanger, forcing the pressurized mixture through a last high pressure mixing zone, wherein the process is characterized in that no repressurization step occurs between steps b) and d).

DETAILED DESCRIPTION OF THE INVENTION

Figure 1:
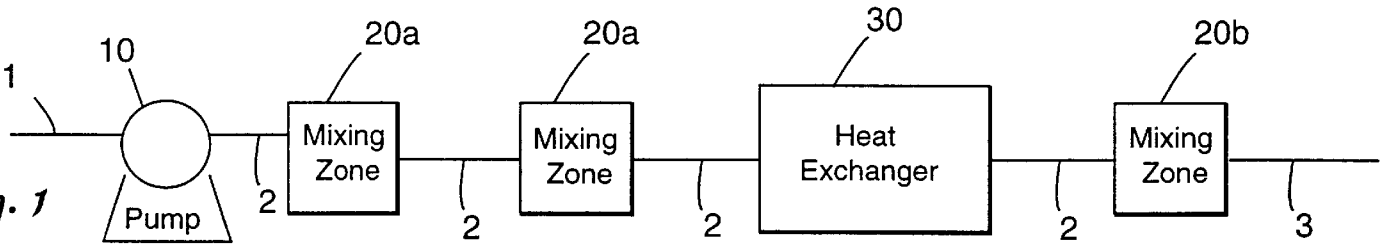
FIG. 1 is a schematic view of the entire apparatus of the present invention including a high pressure pump, a series of mixing zones, and a heat exchanger in the midst of the series of mixing zones.

Referring to FIG. 1, this invention includes pressurizing one or more component stream(s) 1 in one or more pumps 10. The pressurized stream(s) 2 then pass through one or more mixing zones 20*a*. After exiting the mixing zone(s) 20*a*, the stream 2 passes through a high pressure heat exchanger 30. The stream 2 then is passed through at least one additional mixing zone 20*b*. The materials exit the final mixing zone 20*b* as relatively low pressure stream 3. If desired, if three or more mixing zones are used additional heat exchangers may also be used.

The mixing zones of this invention may be any such mixing zones known in the art. Preferably, the mixing zones will be "static", i.e. the apparatus itself will have no moving parts. Such mixing zones typically involve turbulent fluid flow. Examples of such mixing zones include rapidly passing fluid through a narrow orifice into an expanded opening; impinging pressurized streams on a fixed feature in the apparatus such as a wall or baffle; and impinging pressurized streams upon each other. The preferred apparatus and method comprises impinging pressurized streams upon each other.

Figure 2:
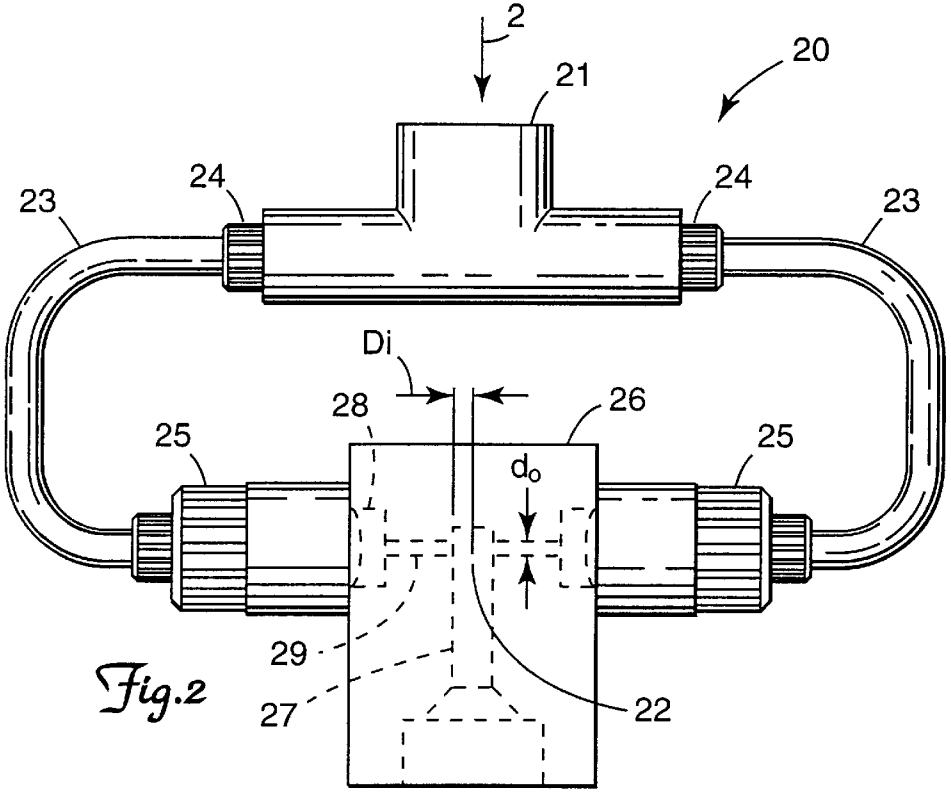
FIG. 2 is a schematic view of one type of individual impingement chamber assembly which may be used as the mixing zone of FIG. 1.

Referring to FIG. 2, one preferred individual jet impingement chamber assemblies 20 includes an input manifold 21 in which the process stream is split into two or more individual streams, an output manifold 26 which contains the impingement chamber in which the individual streams are recombined, and a passage 23 directing the individual streams into the impingement chamber. FIG. 2 shows one preferred construction of the jet impingement chamber assembly. This preferred embodiment includes an input manifold where the process stream is divided into two independent streams. Such an input manifold is not necessary in alternate constructions as discussed below. The input manifold 21 and the output manifold 26 are connected to high pressure tubing 23 by means of gland nuts 24 and 25. The output manifold 26 itself is preferably capable of disassembly so that the orifice cones 28 and extension tubes 29 may be replaced if different parameters are desired or if the parts are worn or plugged. The high pressure tubing 23 is optionally equipped with thermocouples and pressure sensing devices which enable the operator of the system to detect flow irregularities such as plugging. Impingement of the process streams occurs in the impingement zone 22. The impinged materials exit the impingement chamber through the exit channel 27. According to an alternative embodiment the output manifold may include two or more exit channels 27 from the impingement zone. The exit streams can each lead to an individual orifice (or nozzle) in the next impingement chamber, thereby eliminating the need for separate input manifolds. This alternative approach can decrease the residence time of the materials in the system. Such reduction may be especially desirable to compensate for the additional residence time when heat exchangers are added to the system.

In the impingement chamber the streams are recombined by directing the flow of each stream toward at least one other stream. In other words, if two streams are used the outlets must be in the same plane but may be at various angles from each other. For example, the two streams could be at 60, 90, 120, or 180 degree angles from each other, although any angle may be used. If four streams are used, two of the streams could be combined at the top of the impingement chamber and two more combined midway down the exit channel 7 or all four streams could be combined at the top of the impingement chamber. While it is preferred that the orifice cone and extension tubes be perpendicular to the impingement channel, that is not required.

The orifice should be constructed of a hard and durable material. Suitable materials include sapphire, tungsten carbide, stainless steel, diamond, ceramic materials, cemented carbides, and hardened metal compositions. The orifice may be oval, hexagonal, square, etc. However, orifices that are roughly circular are easy to make and experience relatively even wear. As previously mentioned, it is desirable for the exit of the orifice assembly to be free to vibrate. For example, with a tungsten carbide orifice in a stainless steel sleeve, the distance from the point of rigid support of the orifice assembly to the point where the dispersion exits the orifice is preferably at least 13 times the distance to the point of impingement, Di.

The average inner diameter of the orifice is determined in part by the size of the individual particulates being processed. For preparation of a magnetic pigment dispersion preferred orifice diameters range from 0.005 through 0.05 inches (0.1–1 mm). It is preferable that the orifice inner diameter in each succeeding impingement chamber is the same size or smaller than the orifice inner diameter in the preceding impingement chamber. The length of the orifice may be increased if desired to maintain a higher velocity for the process stream for a longer period of time. The velocity of the stream when passing through the final orifice is generally greater than 1000 ft/sec (300 m/s).

The extension tube 29 maintains the velocity of the jet until immediately prior to the point where the individual streams impinge each other. The inner portion of the extension tube may be of the same or different material than the orifice and may be of the same or slightly different diameter than the orifice. The length of the extension tube and the distance from the exit of the extension tube to the center of the impingement chamber has an effect on the degree of dispersion obtained. For magnetic pigment dispersions the distance from the exit of the extension tube to the center of the impingement zone is preferably no greater than 0.3 inches (7.6 mm), more preferably no greater than 0.1 inches (2.54 mm), and most preferably no greater than 0.025 inches (0.6 mm). For at least one of the impingement chambers (most preferably the last chamber) it is preferable that the distance from the exit of the orifice to the point of impingement (Di) is no more than two times the orifice diameter ($d_o$), and more preferably Di is less than or equal to $d_o$.

The inventor has found that, although not necessary, it may be beneficial to provide a filter upstream from the initial impingement chamber assembly. The purpose of this filter is primarily to remove relatively large (i.e., greater than 100 $\mu$m) contaminants without removing pigment particles. As an alternative to this, the inventor has developed a modified input manifold which comprises a filter.

Figure 3:
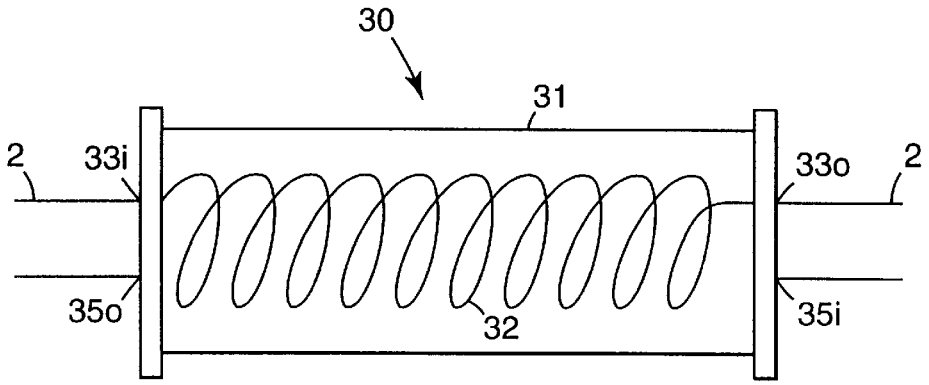
FIG. 3 is a schematic of a heat exchanger useful in this invention.

Referring to FIG. 3, a preferred heat exchanger 30 includes process fluid streams or channels 32 which can handle the high pressure fluid stream. These streams or channels are contained with in the shell 31 of the heat exchanger. The pressurized process fluid stream enters the heat exchanger at 33*i*, passes through the channels 32, and exits the heat exchanger at 33*o*. A cooling material such as water may be used. This cooling liquid enters the heat exchanger at 35*i* and exits the heat exchanger at 35*o*. The channels may be formed by any convenient means. Applicants have found that high pressure tubing works well. Preferably, the tubing can withstand 60,000 psi.

The pressure drop across the series of impingement chambers and heat exchanger(s) preferably is at least 10,000 psi, more preferably greater than 25,000 psi, and most preferably greater than 40,000 psi (- - - MPa). According to one preferred embodiment the pressure drop is largest across the last impingement chamber. If necessary or desired the dispersion or a portion of the dispersion can be recycled for a subsequent pass.

The system and process of this invention are useful in preparing a variety of different mixtures. However, the system has found to be particularly effective in preparing dispersion of pigment and polymeric binder in a carrier liquid. The binder may be a curable binder. Such curable binder systems are frequently sensitive to heat. Thus, the cooler running system of this invention is particularly well suited for dispersions which include curable binders.

EXAMPLE

A system was set up having 8 impingement chambers in series. A heat exchanger was used both before the pump and after the series of impingement zones. The mixture run through the system had the following formulation:

| | |
|---|---|
| THF | 378.2 parts |
| Cyclohexanone | 49.32 parts |
| Wetting agent | 1.17 parts |
| carbon black | 30.33 parts |
| $TiO_2$ | 7.56 parts |
| Alumina | 1.26 parts |
| Binder (nitrocellulose and polyurethane) | 29.07 parts |

The material was recycled 8 times. The system pressure, the temperature upon exit from the input heat exchanger, the pressure before impingement chamber 7, the temperature upon exit from impingement chamber 7, the pressure before impingement chamber 8, the temperature upon exit from impingement chamber 8, and the temperature upon exit from the output heat exchanger are found in the Table below. For the experimental system the temperature upon exit from a heat exchanger placed between the seventh and eighth impingement chambers is also provided.

| Sample | Cycle # | System Pressure (psi) | Temp (F.) on exit from input heat exchanger | Pressure (kpsi) before chamber 7 | Temp (F.) on exit from impingement chamber 7 | Temp (F.) on exit from high pressure heat exchanger | Pressure (kpsi) before chamber 8 | Temp (F.) on exit from impingement chamber 8 | Temp (F.) on exit from output heat exchanger |
|---|---|---|---|---|---|---|---|---|---|
| Control | 1 | 32,400 | 111 | | 144 | na | | 191 | 72 |
| Exp. | 1 | 33,300 | 102 | 23.5 | 118 | 61 | 19.5 | 84 | 66 |
| Control | 2 | 34,500 | 114 | | 157 | na | | 201 | 72 |
| Exp. | 2 | 33,400 | 104 | 25.2 | 136 | 64 | 20,2 | 93 | 65 |
| Control | 3 | 31,300 | 95 | | 143 | na | | 181 | 70 |
| Exp. | 3 | 33,200 | 94 | 25.3 | 142 | 65 | 20.3 | 97 | 66 |
| Control | 4 | 32,200 | 111 | | 159 | na | | 198 | 71 |

-continued

| Sample | Cycle # | System Pressure (psi) | Temp (F.) on exit from input heat exchanger | Pressure (kpsi) before chamber 7 | Temp (F.) on exit from impingement chamber 7 | Temp (F.) on exit from high pressure heat exchanger | Pressure (kpsi) before chamber 8 | Temp (F.) on exit from impingement chamber 8 | Temp (F.) on exit from output heat exchanger |
|---|---|---|---|---|---|---|---|---|---|
| Exp. | 4 | 33,600 | 106 | 26.2 | 148 | 65 | 20.2 | 99 | 65 |
| Control | 5 | 34,500 | 112 | | 162 | na | | 198 | 72 |
| Exp. | 5 | 32,400 | 107 | 26.2 | 153 | 67 | 21.1 | 101 | 67 |
| Control | 6 | 33,100 | 107 | | 141 | na | | 196 | 76 |
| Exp. | 6 | 32,200 | 103 | 25.3 | 104 | 67 | 20.4 | 84 | 72 |
| Control | 7 | 31,300 | 107 | | 148 | na | | 196 | 78 |
| Exp. | 7 | 34,300 | 102 | 25.4 | 124 | 71 | 19.8 | 90 | 70 |
| Control | 8 | 13,200 | 90 | | 125 | na | | 133 | 73 |
| Exp. | 8 | 12,700 | 92 | 10.2 | 126 | 70 | 7.9 | 88 | 70 |

When the materials were processed through the control system, although the temperature would be adequately reduced in the output heat exchanger, the temperature became extremely elevated while in the series or impingement zones. In contrast, merely providing one heat exchanger in the midst of the series provides a much more level temperature profile.

Figure 4:
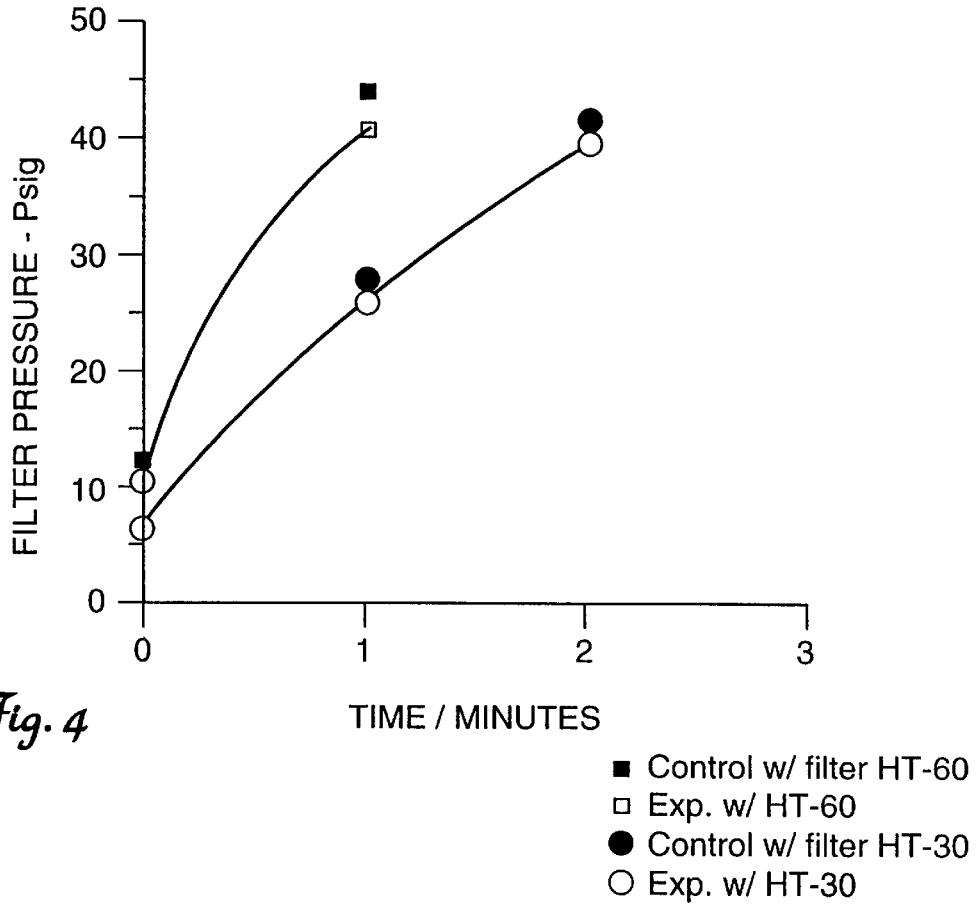
FIG. 4 is a graph showing the effect of the heat exchanger on dispersion quality.

The results in filterability through Nippon Roki HT-60 and HT-30 filters are shown in FIG. 4. As can be seen from that Figure, the Control system has a poorer dispersion as evidenced by higher filter pressures and faster plugging of the filter.

What is claimed is:

1. A process of making multi-phase mixtures comprising the steps of:

a) pressurizing components of the mixture b) passing the components through a first high pressure mixing zone, c) after passing the components through the first mixing zone, passing the pressurized components through a heat exchanger to cool the components, and d) after passing the pressurized components through the heat exchanger, forcing the pressurized mixture through a last high pressure mixing zone, wherein the process is characterized in that no repressurization step occurs between steps b) and d).

2. The process of claim 1 wherein the high pressure mixing zones comprise impinging two or more streams of the components upon each other.

3. The process of claim 2 wherein each of the impinging streams pass through a nozzle and the nozzles of the last high pressure mixing zone are smaller than the nozzles of the first high pressure mixing zone.

4. The process of claim 2 wherein each of the impinging streams pass through a nozzle and the distance from the exit of the nozzle to the point of impingement is less than two times the diameter of the nozzle.

5. The process of claim 4 wherein the distance from the exit of the nozzle to the point of impingement is less than the diameter of the nozzle.

6. The process of claim 1 wherein the components are recycled through the process by introducing the mixture exiting the last high pressure mixing zone into the first high pressure mixing zone under pressure.

7. The process of claim 1 wherein the components are cooled before the pressurizing step (a).

8. The process of claim 1 wherein the components are further cooled after passing through the last high pressure mixing zone.

9. The process of claim 1 wherein the components comprise a polymeric binder, a pigment and a carrier liquid.

10. The process of claim 9 wherein the pigment is a magnetic pigment.

11. An apparatus for preparing mixtures comprising a high pressure pump which pressurizes components of the mixture, a first high pressure mixing zone in which the components are mixed by flowing through the first zone, a high pressure heat exchanger in which the components are cooled after passing through the first high pressure mixing zone, and a last high pressure mixing zone in which the components are mixed by flowing through the second zone.

12. The apparatus of claim 11 in which the high pressure mixing zones comprise at least two nozzles and a region where the components passing through the nozzles can impinge upon each other.

13. The apparatus of claim 12 in which the nozzles in the last high pressure mixing zone are smaller than the nozzles in the first high pressure mixing zone.

14. The apparatus of claim 12 in which the distance from the exit of the nozzle to the point of impingement is less than two times the diameter of the nozzle.

15. The apparatus of claim 12 in which the distance from the exit of the nozzle to the point of impingement is less than the diameter of the nozzle.

16. The apparatus of claim 11 further comprising a low pressure heat exchanger after the last high pressure mixing zone.

17. The apparatus of claim 11 further comprising a heat exchanger before the high pressure pump.

* * * * *